US005201435A

United States Patent [19]

Harding et al.

[11] Patent Number: 5,201,435

[45] Date of Patent: Apr. 13, 1993

[54] STORAGE TANK FOR COMBUSTIBLE LIQUIDS

[75] Inventors: Charles W. Harding, Clarkston; John L. Hilfiker, White Lake; James H. Hull, Grosse Pointe Woods, all of Mich.

[73] Assignee: Clawson Tank Company, Clarkston, Mich.

[21] Appl. No.: 766,452

[22] Filed: Sep. 26, 1991

[51] Int. Cl.[5] ..... B65D 90/16

[52] U.S. Cl. ..... 220/415; 220/571

[58] Field of Search ..... 220/415, 448, 571

[56] References Cited

U.S. PATENT DOCUMENTS

| | | | |
|---|---|---|---|
| 1,520,230 | 6/1924 | Flath . | |
| 1,970,940 | 5/1934 | Laube | 72/14 |
| 2,777,295 | 10/1957 | Bliss et al. | 62/1 |
| 3,125,388 | 3/1964 | Costantini et al. | 220/415 |
| 3,338,010 | 11/1967 | Waugh | 52/249 |
| 3,352,443 | 7/1967 | Sattelberg et al. | 220/9 |
| 3,473,689 | 8/1969 | Hutter | 220/18 |
| 3,930,590 | 3/1976 | Ebbrell | 220/9 |
| 4,425,743 | 12/1984 | Bartur | 52/169 |
| 4,519,415 | 9/1985 | Carn | 137/318 |
| 4,714,170 | 3/1987 | Scott | 220/5 |
| 4,960,222 | 10/1990 | Fields, III | 220/571 |
| 4,976,912 | 12/1990 | Madle et al. | 220/415 |
| 5,033,638 | 7/1991 | Cruver | 220/571 |

*Primary Examiner*—Joseph Man-Fu Moy

*Attorney, Agent, or Firm*—Barnes, Kisselle, Raisch, Choate, Whittemore & Hulbert

[57] ABSTRACT

An above ground storage facility for volatile and inflammable liquids which includes a concrete vault formed as a base and cylindrical upstanding walls on or integral with said base. An inner liquid container formed of metal has a metal base resting on ribs of the vault base to space the metal container from the vault base. Cylindrical walls of the liquid container are sealed to and rise from said metal base. The walls of the metal container are spaced inwardly from the inner surface of the vault walls to leave an annular envelope of air around the metal container. A conical roof is secured and sealed to the upper edges of the metal cylindrical walls and the roof has peripheral edges which overlie and are spaced from the upper edges of the concrete wall and the annular air envelope around the steel container. The roof edges are shaped to protect the space between the vault and the container from the elements while allowing air passage from the envelope to the atmosphere to allow escape of condensate which may collect on the steel container or on the inner surface of the vault walls.

16 Claims, 3 Drawing Sheets

STORAGE TANK FOR COMBUSTIBLE LIQUIDS

FIELD OF INVENTION

Design and construction of large, above ground storage tanks for combustible liquids with containment areas and fireproof vault.

BACKGROUND AND FEATURES OF THE INVENTION

The storage of combustible and flammable liquids such as gasoline, diesel fuel and other similar liquids has long been a problem. With above ground tanks, it has been common to provide a collecting space in the form of a surrounding trench or well which would contain the liquid of the tank in the event of a spill U.S. Pat. No. 3,930,590 to Ebbrell illustrates such a collecting space. There has been no containment in the event of fire in these surrounding trenches.

It is an object of the present invention to provide an above ground storage facility including an inner steel tank for the desired quantity of liquid. A fireproof concrete vault encases the inner tank but provides an annular space between the outside of the inner tank and the inside of the outer tank to serve as a containment volume for any liquid escaping from the steel tank and also as a fire barrier in the event of combustion.

The invention contemplates a unique base construction with a reinforced outer vault and ventilation wall configurations to dissipate condensation. Thus, the tank walls and bottom can remain dry and avoid rusting and corrosion.

A further object is a steel cone roof which encloses the inner tank but also extends over the annular containment volume to prevent entrance of the elements while providing ventilation of the included annular space between the tank and the enclosing vault. Thus, condensation can be dissipated.

The outer vault can be constructed of a selected concrete which has a high resistance to flame and heat as well as bullet proof and may also be constructed of annular vertical sections with sealed joints to enable the height of the overall structure and the resulting volume to be selected for particular needs.

A still further object is the provision of an angled bottom construction with snifter connections and sump evacuations when desired.

Additional objects and features of the invention will be apparent in the following description and claims which, in connection with appended drawings, will enable persons skilled in the art to practice the invention, all in relation to the best mode presently contemplated for the invention.

BRIEF DESCRIPTION OF THE INVENTION

An inner steel tank has a bottom supported on transversely spaced, angled, parallel bars resting on a concrete base. A concrete vault formed of annular sections joined annularly in a sealed joint, is positioned around the tank and has outside vertical flutes for reinforcement. The vault is spaced a significant radial distance from the walls of the tank to provide a containment volume for any accidental leakage of flammable liquid from the inner tank. A conical roof seals the top of the inner tank but also extends over the annular space between the tank and the vault a sufficient distance to exclude the elements while allowing ventilation for condensation.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
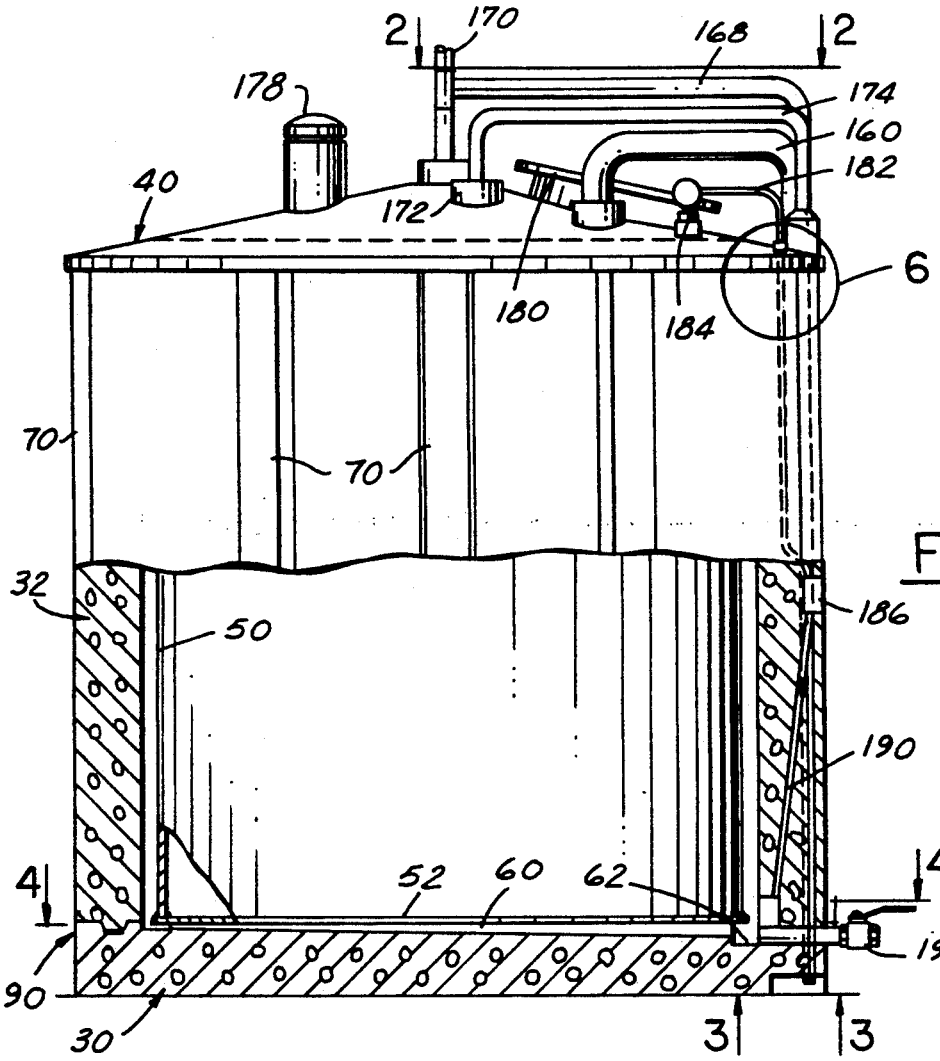
FIG. 1, an elevation partly in section of a tank and vault assembly.
Figure 6:
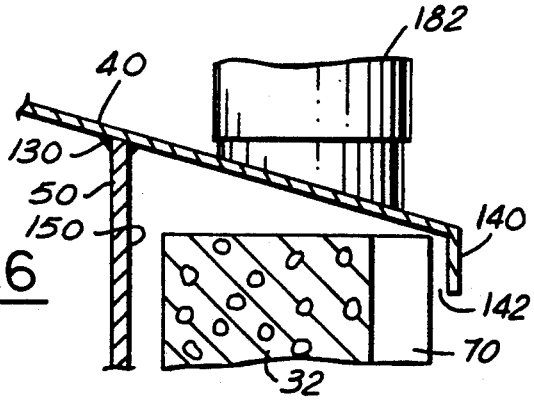
FIG. 6, an enlarged section roof detail at circle 6 of FIG. 1.

With reference to the drawings, in FIG. 1, an assembly, partly in section, is shown with a base 30 of concrete, a cylindrical wall 32 of cast concrete, and a conical metal roof 40. Inside the wall 32 is a steel tank 50. In FIG. 6, a section of the corner of the roof at circle 6 is shown. The tank has a base plate 52. The flat base plate 52 is welded in sealed relation to the wall 50.

Figure 4:
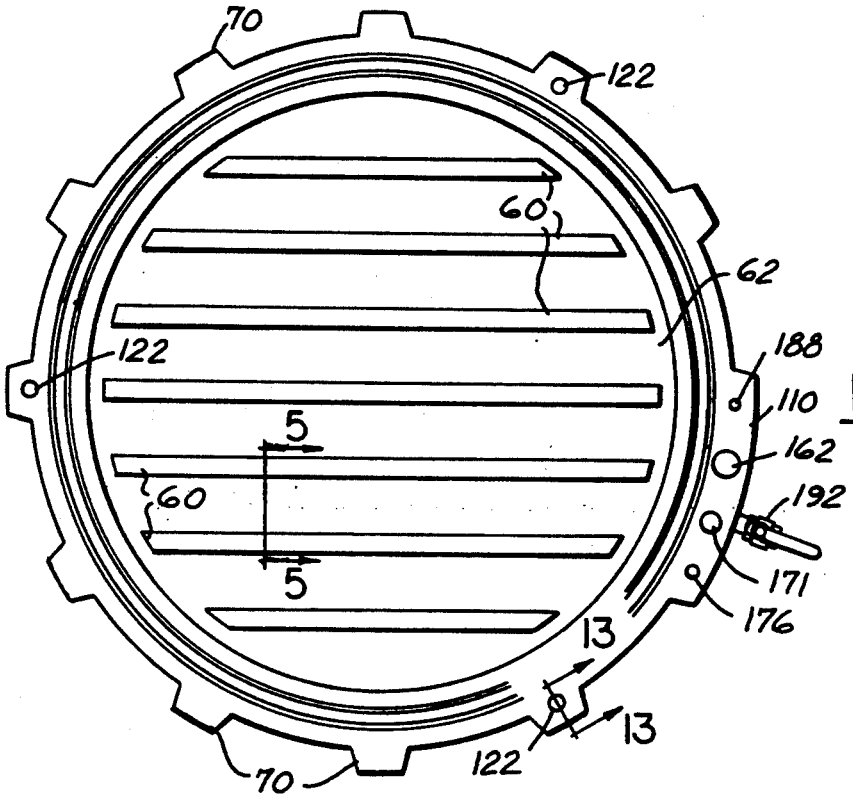
FIG. 4, a plan of the tank base at line 4—4 of FIG. 1.

In FIG. 4, a plan view of the base 30 is illustrated. In preparing the foundation for the base, an area will be prepared, three feet greater than the outside diameter of the tank, with a compacted crushed layer of rock about 12" deep. If building on asphalt, a three-inch layer of asphalt can be laid on a six inch, well graded sub-base compacted crushed rock. If concrete is the basic support, a four-inch slab of reinforced concrete should have a base of four-inch, well-graded crushed rock compacted to 95% of density.

Figure 5:
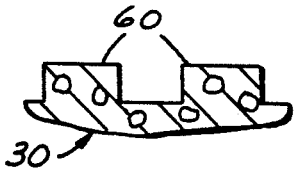
FIG. 5, a section on line 5—5 of FIG. 4.

The base 30 has, for example, a diameter varying from 64" to 116" and is formed with upstanding parallel ribs 60 (FIG. 4) shown in section in FIG. 5. The ribs have a width, for example, of 2 inches and vary in depth from one to one and a half inches. The spacing is about 8" between centers. The change in height is illustrated in FIG. 1 where the base plate 52 of the tank 50 is level and there is decreasing thickness of base 30 to compensate for the varying vertical thickness of the spaced and parallel ribs 60. This will provide a drainage to a sump basin and leak detection opening 62 later to be described. The raised supports 60 on the angled base 30 prevent moisture accumulation against the tank bottom, thus preventing exterior corrosion. The sump basin extends around the base of the container at the low area of the base 30.

The concrete base 30 and the cylindrical walls 32 are preferably made with Siliceous Aggregate Concrete with a thickness of about 6". This will provide a fire endurance, internally or externally, of about 3 hours based on 250° F. (139° C.) rise in temperature of unexposed surface, according to American Concrete Institute, while maintaining structural integrity.

Figure 2:
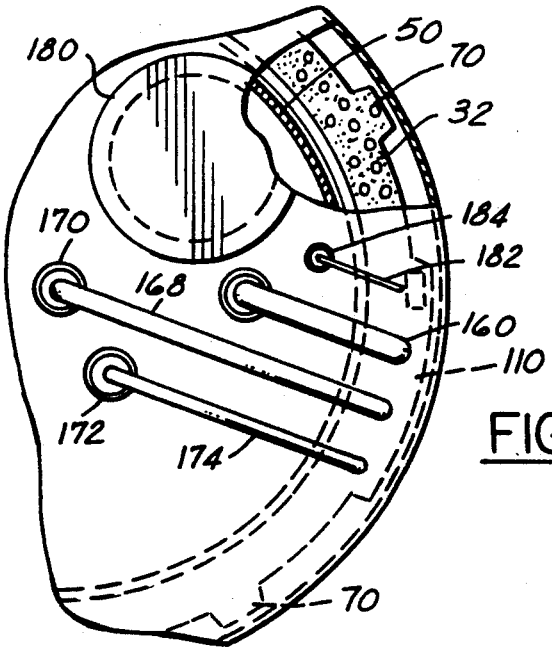
FIG. 2, a top view of the assembly on line 2—2 of FIG. 1.
Figure 8:
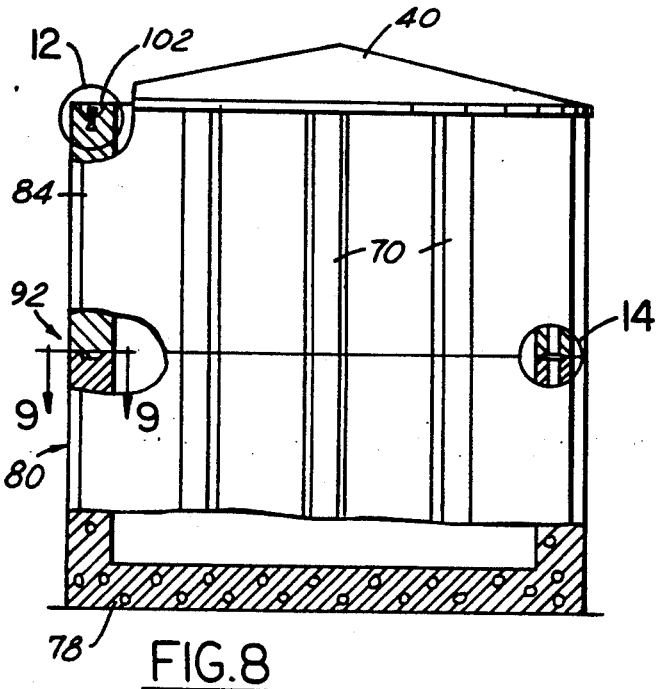
FIG. 8, a diagrammatic view of a modified vault construction.
Figure 9:
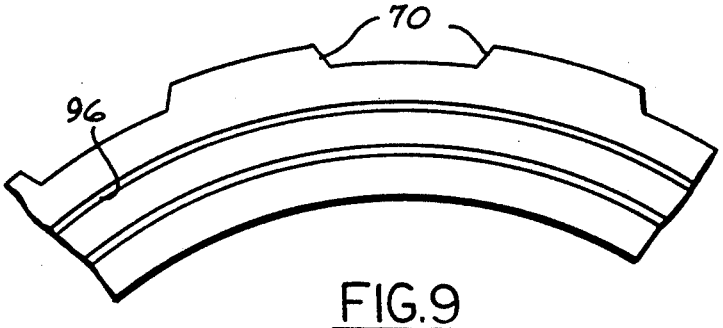
FIG. 9, a section on line 9—9 of FIG. 8.

The vault walls are precast, cylindrical reinforced concrete chambers with architecturally textured exterior appearance and outside circumferentially spaced vertical flutes 70 as shown in FIGS. 1, 2 and 4. In FIGS. 8 and 9, a modified outer vault is composed of a base section 78 with outside flutes 70 and a top section 84 which will house the steel inner container 50. The flat base section 78, which will have spaced support ribs as in FIG. 1, is integrally cast with a rising side wall 80.

Figure 10:
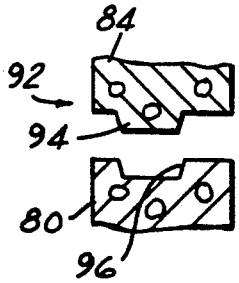
FIG. 10, a view of the vault section joints.
Figure 11:
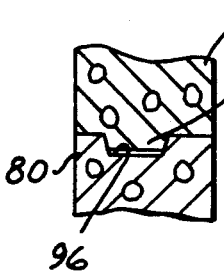
FIG. 11, a view of the joint closed with a fireproof sealant.

Thus, the annular chambers, depending on the desired height, can be a single chamber as in FIG. 1 or superimposed chambers 80 and 84 as illustrated in FIG. 8. In FIG. 1, the joint 90, between the wall 32 and the base 30, will be sealed, preferably with a liquid tight, fire-resistant Dow Corning 790 silicone building sealant applied in a continuous operation. A positive pressure, adequate properly to fill and seal the joint width, should be employed. All surfaces should be covered before the parts are joined. The same sealant can be used at the joint 92 in FIG. 8 between two stacked chambers 80 and 84. A key lock dovetail joint 92 (FIGS. 10, 11) has a male annular ridge 94 which is received in a groove 96 after the sealant is properly applied. A closed-cell nitrile, rubber foam gasket can be adhered to the root of the groove 96 of the key lock prior to assembly.

Figure 12:
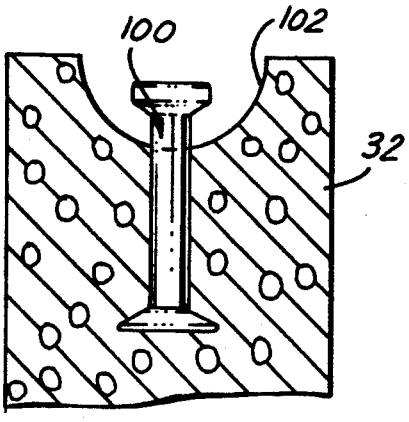
FIG. 12, a view of an embedded pick-up bolt at circle 12 of FIG. 8.
Figure 7:
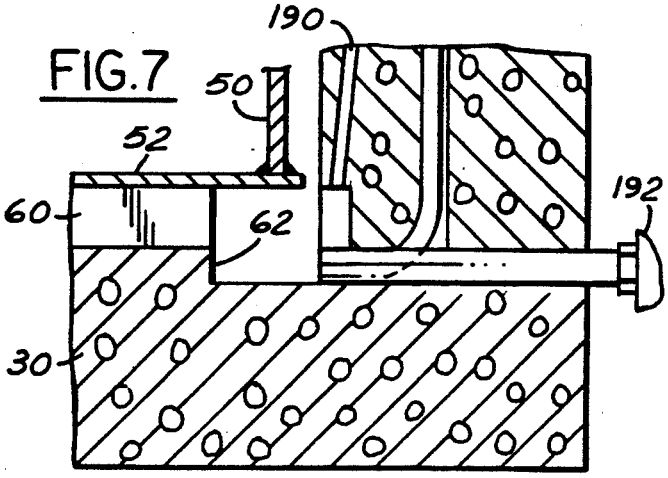
FIG. 7, an enlarged sectioned view of the lower right corner of the tank and vault of FIG. 1.

The units will incorporate embedded lift anchor bolts 100 in pockets 102 as shown in FIG. 12 used with suitable lifting eye hooks for installation, or removal for maintenance.

As shown in FIG. 4, a wider flute 110 is provided to house vertical conduits as will be described.

Figure 13:
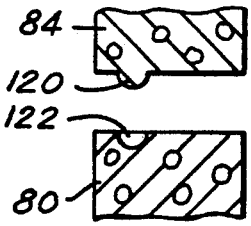
FIG. 13, a sectional view of interfitting locator projections on axially mating vault walls at line 13—13 of FIG. 4.

Alignment dimples, FIG. 13, can be provided properly to orient the riser to base and the riser to riser connection consisting of male protrusions 120 on one mating surface to fit into depressions 122 on the other mating surface. With these locator protrusions, the flutes on the exterior wall and conduit passages can be properly aligned.

After assembly of the concrete vault wall or walls, and after suitable liquid tight seals are in place, the steel tank 50 is lowered with suitable hoisting equipment into the vault to rest on the ribs 60. As indicated above, the concrete vault walls can be varied from 4" to about 6" thick. The outer dimension of the tanks within the vaults may vary depending on how much volume is desired between the tank and the inner wall of the vault to contain possible leakage in the event of accidental rupture of the inner tank.

The concrete vault cylinder may be a one-piece unit as shown in FIG. 1 with wall 32 sealed at the base 30, or a two-piece unit as viewed in FIG. 8 where the base 78 is integral with the cylindrical wall 80. The upper vault 84 is sealed at 92 in a joint illustrated in FIGS. 10 and 11. When the inner steel tank is installed in the concrete container of FIG. 1 or FIG. 8, there is then an air envelope surrounding the inner tank and open at the top to the outwardly extending protective edge of the top wall 40. The vertical flutes on the outside of the concrete container not only reinforce the container walls but assist the upward flow of air around the container and in the outward flow of the air envelope surrounding the inner tank.

A conical cover unit 40 overlies the concrete vault and the enclosed tank as viewed in FIGS. 1, 6 and 8. This conical cover is preferably formed of steel which is welded at 130 to the top rim of the inner steel shell 50. The cover extends radially beyond the outer surface of the concrete vault wall 32 as shown in FIG. 6 and has an outer depending rim flange 140 which overlies but is spaced from the outer diameter of the concrete vault as at 142 in FIG. 6. Thus, the inner space 150 between the outer surface of the steel tank and the inner surface of the concrete vault is protected from the elements but this space is provided with ventilation to allow the escape of condensation that may occur in the inner annular chamber 150.

Various connections may be made through the cover unit and the vault walls. For example, a fill pipe 160 is connected through a vertical conduit 162 (FIG. 3) in the wall 110 of the vault to an underground supply passage (not shown).

Figure 3:
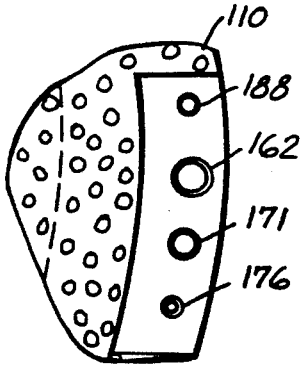
FIG. 3, a section on line 3—3 of FIG. 1.
Figure 14:
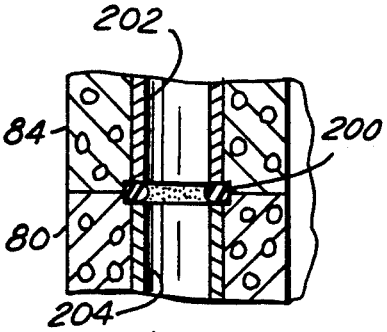
FIG. 14, a view of a seal for aligning passages in the vault walls taken at circle 14 in FIG. 8.

A vent line 168 on the cover, connected to a working vent 170, is connected to a conduit 171 in the vault wall (FIG. 3). A connector 172 on top 40 leads to suction line 174 which connects to a passage 176 in the vault wall. An emergency vent 178 is provided in the cone top 40. A manhole port 180 is provided, and an electrical conduit 182 connects to an electronic liquid level gauge 184 in the tank and to a connection box 186 through conduit 188 in the vault wall. A leak detector passage 190 extends down to a sump 62 (FIG. 1) with a suitable connection to the box 186. A fireproof valve 192 is provided at this position on the exterior of the vault. These passages are exemplary only and shown diagrammatically. Various passages with varying function can be utilized. It is important, of course, that passages in a stacked vault wall be properly aligned as the vault sections are assembled. This can be done with removable pins in the top section which will enter corresponding passages in the lower section. The passage joints in stacked sections can be sealed by doughnut shaped neoprene, or equivalent, rings 200, FIG. 14, which will be compressed to form a seal between portions 202 and 204, in, for example, a fill passage 162 (FIG. 3).

What is claimed is:

1. An above ground storage container for volatile liquids which comprises:

(a) an inner steel tank having a base wall, and side walls for containing volatile inflammable liquids, (b) an outer surface container having a base and side walls surrounding said inner tank, the base and side walls of said concrete container being separated from the walls of said inner tank to provide an air envelope around the base and side walls of said inner tank, and (c) an enclosing top wall sealingly carried by the side walls of said inner tank to contain volatile inflammable liquids within said inner tank, and said enclosing top wall overlying the outer side walls of said concrete container and being spaced vertically above said concrete container to allow air flow into said air envelope from exterior of said concrete container and from said air envelope to the exterior and for protecting said envelope from the elements.

2. An above ground storage container as defined in claim 1 in which said base of said concrete container is provided with spaced ridges to separate said tank base from said container base.

3. An above ground storage container as defined in claim 2 in which the surface of said container base below said spaced ridges is angled downwardly to a sump passage to allow drainage of any condensate or leakage.

4. An above ground storage container as defined in claim 1 also comprising, a plurality of vertical flutes spaced circumferentially around the outer surface of said concrete container to assist in the upward flow of air ground said concrete container and in the inward and outward flow of air to and from said air envelope to ventilate said air storage.

5. An above ground storage container as defined in claim 1 in which the outer edge of said top wall extends beyond the outer circumference of said concrete container and a depending annular flange on said top wall extends downwardly to a position below the top of said concrete container.

6. An above ground storage container as defined in claim 1 wherein said enclosing top wall is generally conical.

7. An above ground storage container as defined in claim 1 which said concrete container comprises a base and one or more annular side walls mounted on said base surrounding said inner tank.

8. An above ground storage container as defined in claim 1 in which said concrete container comprises a base and an integral annular side wall rising around the periphery of said base.

9. An above ground storage container as defined in claim 8 in which a second annular side wall is positioned in sealed relation above said integral side wall.

10. An above ground storage container as defined in claim 1 in which said wall of said container comprises a plurality of annular walls stacked vertically and a sealed joint between the registering edges of said annular walls in the form an annular groove in one of said edges and a mating male ridge in the other of said edges.

11. An above ground storage container as defined in claim 7 in which aligning protrusions on the edge of one of said annular side walls register with complemental recesses on the edge of another side wall.

12. An above ground storage container as defined in claim 7 in which vertical functional passages in a portion of one of said annular side walls register with vertical passages in another of said side walls, and sealing means is positioned between the registering ends of said passages in the form of an annular sealing element which is compressed between said annular side walls upon assembly.

13. An above ground storage container as defined in claim 1 wherein said enclosing top wall is sealingly weldably attached to the top rim of the side walls of said inner tank.

14. An above ground storage container as defined in claim 1 wherein said flutes are integral with the side walls of said outer concrete container.

15. An above ground storage container as defined in claim 1 also comprising, at least one vertical conduit in one or more of said flutes to provide a path for electrical wiring, filling said inner tank, leak or level detection, and/or drawing liquid from the tank.

16. An above ground storage container for volatile liquids which comprises:

(a) an inner steel tank having a base wall, and side walls for containing volatile inflammable liquids, (b) an outer concrete container having a base and side walls surrounding said inner tank, the base and side walls of said concrete container being separated from the walls of said inner tank to provide an air envelope around the base and side walls of said inner tank, (c) an enclosing top wall sealingly carried by the side walls of said inner tank to contain volatile inflammable liquids within said inner tank, and said enclosing top wall overlying the outer side walls of said concrete container and being spaced vertically above said concrete container to allow air flow into said air envelope from exterior of said concrete container and from said air envelope to the exterior and for protecting said envelope from the elements, and (d) a plurality of vertical flutes spaced circumferentially around the outer surface of said concrete container to assist in the upward flow of air around said concrete container and in the inward and outward flow of air to and from said air envelope to ventilate said air envelope.

* * * * *

UNITED STATES PATENT AND TRADEMARK OFFICE

CERTIFICATE OF CORRECTION

PATENT NO. : 5,201,435

DATED : April 13, 1993

INVENTOR(S) : Charles W. Harding, John L. Hilfiker, James H. Hull

It is certified that error appears in the above-indentified patent and that said Letters Patent is hereby corrected as shown below:

Col. 4, Line 50, change "surface" to — concrete —.

Signed and Sealed this

Twenty-seventh Day of February, 1996

Bruce Lehman

*Attest:*

BRUCE LEHMAN

*Attesting Officer*

*Commissioner of Patents and Trademarks*